United States Patent [19]

Beck

[11] 3,984,616

[45] Oct. 5, 1976

[54] HIGH TEMPERATURE FURNACE HEATER

[75] Inventor: Jacob Howard Beck, Waban, Mass.

[73] Assignee: BTU Engineering Corporation, North Billerica, Mass.

[22] Filed: Oct. 14, 1975

[21] Appl. No.: 622,235

[52] U.S. Cl. ..... 13/25; 219/406; 219/532; 219/542; 219/552; 338/280; 338/283; 338/282

[51] Int. Cl.[2] ..... H05B 3/06; F27D 11/02

[58] Field of Search ..... 13/22, 25; 219/390, 219/395, 406, 411, 532, 542, 552, 553; 338/279, 280, 282, 283, 284, 287, 289, 288, 291, 292, 293

[56] References Cited

UNITED STATES PATENTS

| | | | |
|---|---|---|---|
| 1,928,142 | 9/1933 | Trent et al. | 13/25 X |
| 2,424,780 | 7/1947 | Trent | 13/22 X |
| 2,856,496 | 10/1958 | Fisher | 338/285 |
| 3,118,042 | 1/1964 | Parker | 13/25 X |

*Primary Examiner*—R. N. Envall, Jr.
*Attorney, Agent, or Firm*—Weingarten, Maxham & Schurgin

[57] ABSTRACT

A high temperature unitary electrical resistance heater which is mechanically supported throughout its active length but spaced from a refractory base with the heating element being substantially free of the supporting structure to provide an efficient heater having relatively low thermal inertia while being rigidly supported for high temperature operation. A flat continuous electrical resistor ribbon is folded in a multiple loop helix-like configuration formed of a plurality of straight segments and a repetitive array of folded, overlapped corner portions. A strut is interposed within each folded corner and welded therein, outwardly extending end portions of each strut being rigidly secured in a refractory base structure with the resistor ribbon being spaced along its active length from the base structure.

7 Claims, 3 Drawing Figures

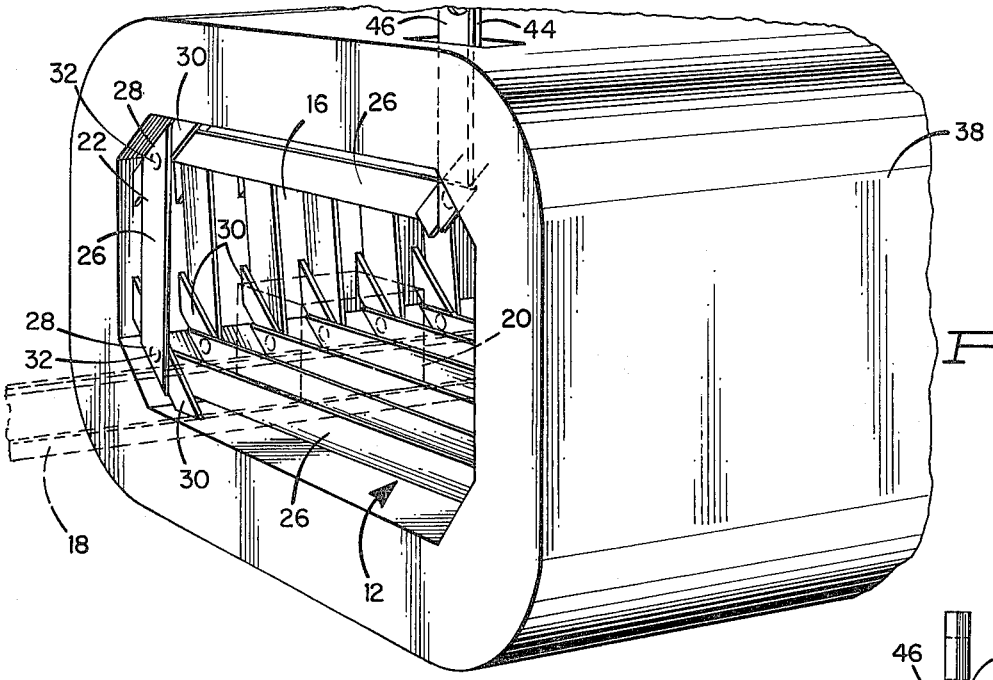
Fig. 1.
Fig. 3.
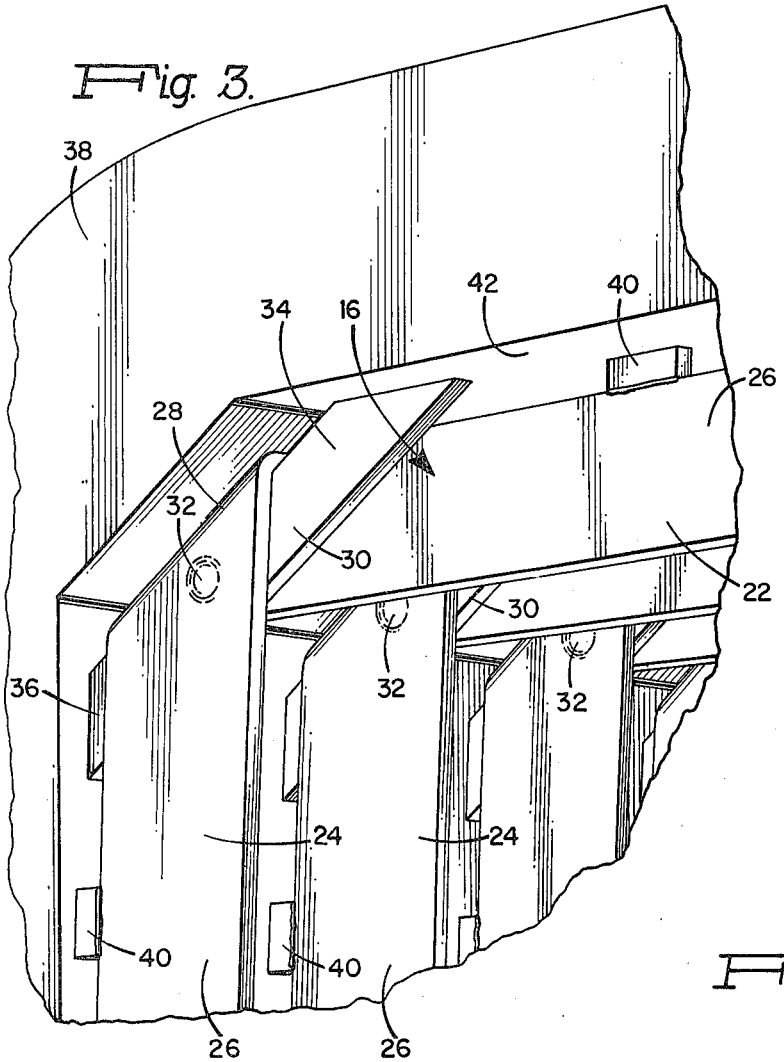
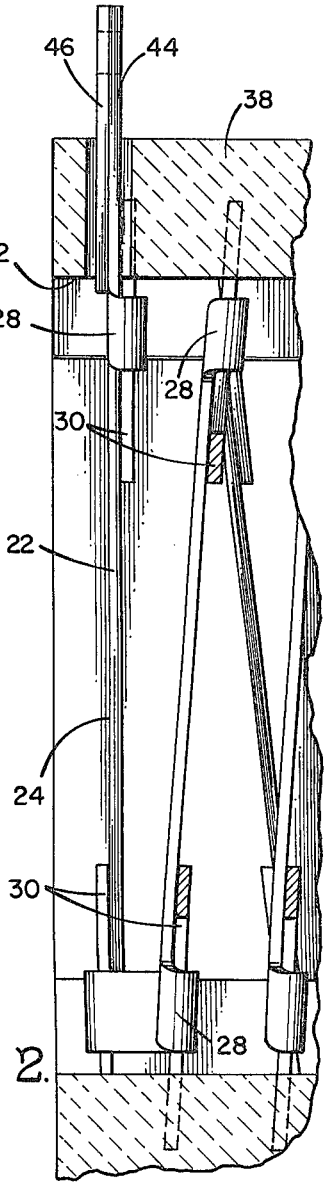
Fig. 2.

HIGH TEMPERATURE FURNACE HEATER

FIELD OF THE INVENTION

This invention relates to heating elements of high temperature electrical furnaces and more particularly to an electrical resistance heater formed of a continuous flat electrical resistance element folded in a helical path and rigidly supported by refractory means spaced from the heater.

BACKGROUND OF THE INVENTION

Heating coils employed in electrical furnaces operative at exceedingly high temperatures are typically supported by ceramic cores such as grooved plates or cylinders wherein the heater is supported and often confined throughout its entire length by the ceramic structure. The weight of the ceramic support structure constitutes a major percentage of the overall heater assembly mass by reason of the amount of ceramic necessary for support of the heating element and the inherent density of the ceramic material. As a result of the relatively massive amount of ceramic material present in a heater assembly of conventional construction, the heater exhibits a high thermal inertia which limits the rapidity with which a change of temperature can be accomplished. The response of such conventional heaters to temperature control is thereby limited by the relatively slow thermal response of the heater structure.

The function of the ceramic core in each of these prior heaters is to support and contain the electrical heating element. The core may be composed of a cylindrical rod or a circular or rectangular plate having a plurality of longitudinal re-entrant slots or grooves formed in the peripheral surface thereof and rubbing the length of said surface. These grooves, due to the limitations imposed by the ceramic material, are necessarily of small diameter and will expose at the maximum one fifth the surface area of the electrical heating element itself. The ceramic core therefore effectively shades at least 80% of the direct radiation emitted by the coil to the product, thus providing a low standard of emissivity. This low emissivity in turn promotes a substantial differential in temperature between the product and the heating element, causing efficiency and shorter heater life.

Another well known form of heating coil employs three-eighths inch relatively heavy heating rod, typically three/eighths in diameter, wound in a helical configuration. Ceramic spacers are interposed between turns of the helix to maintain spacing of the heater turns. This type of heater construction depends on the radial arch of the heater rod for support, and the rod has to support itself as well as the interposed ceramic spacers. The additional weight presented by the ceramic spacers contributes to sagging of the heating rod at high temperatures and shading of a significant portion of the heating surface.

Examples of prior devices are shown in U.S. Pat. Nos. 2,870,308; 3,651,304; 3,673,387; 3,783,238 and 3,798,417. A high temperature heater which overcomes the deficiencies of the prior art is the subject of copending application Ser. No. 622231, filed of even date herewith, entitled ELECTRICAL RESISTANCE FURNACE HEATER and assigned to the same assignee as the present invention.

SUMMARY OF THE INVENTION

In brief, the present invention provides a high temperature electrical resistance heater having a rapid heat-up time and capable of efficient radiation with less than half the weight of a conventional heater structure. The novel heater comprises a flat, continuous electrical resistor ribbon folded in a multiple loop, rectangular helix-like configuration formed of a plurality of straight segments and a repetitive array of folded overlapped corner portions. The ribbon segments have flat spaced confronting surfaces which are generally transverse to the longitudinal axis of the helix. A strut is sandwiched within each folded corner and welded to the confronting portions of the ribbon, each strut having two outwardly extending end portions disposed in the planes of the flat confronting surfaces, with each outwardly extending strut portion being angularly disposed with respect to the adjacent straight segment of the ribbon. The outermost ends of the plurality of struts are rigidly secured in a refractory base structure with the resistor ribbon being spaced along its active length from the confronting surface of the base structure. The resistor ribbon is rigidly supported by the struts and base structure but is spaced from the refractory base such that the base forms no material part of the heater structure, with the result that the heater has a lower thermal inertia and is more efficiently controllable to achieve faster heating and cooling.

The struts welded into the folded corners of the rectangular helix and secured with the refractory base provide support for the entire heater and maintain the spacing of the heater turns. No ceramic spacers are required between turns of the heater, as in conventional heater constructions. The welded overlapped corner portions of the heater are also of decreased electrical resistance, thereby decreasing the temperature of the corner portions with temperature distribution being determined by control of the size of the weld. The novel heater is less than half the weight of a corresponding round rod circular heater with ceramic spacers providing the same radiation surface area and heat emission. The heat-up time of the present heater is also substantially less than that of a conventional round rod heater since no ceramic support structure or ceramic spacers are needed within the heater itself. The rapid heat-up provided by the invention is especially important in batch furnaces such as used in the diffusion of semiconductor materials. In addition, the rapid heating and cooling of the novel heater provides substantial savings in energy.

DESCRIPTION OF THE DRAWINGS

The invention will be more fully understood from the following detailed description taken in conjunction with the accompanying drawings in which:

FIG. 1 is a partially cutaway pictorial representation of a furnace having a heater constructed according to the invention;

FIG. 2 is a side elevation of the heater of FIG. 1; and

FIG. 3 is a cutaway pictorial view of a portion of the heater of FIGS. 1 and 2.

DETAILED DESCRIPTION OF THE INVENTION

Referring to FIG. 1, there is shown a furnace 10 having an electrical furnace heater 12 constructed and operative in accordance with the present invention. The furnace is typically formed of appropriate firebrick (not shown) which encloses the heater chamber 16 within which the heater is disposed for operation. A conveyor 18 is disposed within furnace chamber 16 and extends therethrough for support of a product 20 through the furnace for thermal processing. The details of the furnace and its conveyor have been omitted for clarity since these form no part of the present invention.

The heater 12 which is additionally shown in FIGS. 2 and 3 comprises a flat, continuous electrical resistor ribbon 22 folded into a multiple turn helix-like configuration with the flat confronting surfaces 24 of the ribbon being spaced from one another and generally transverse to the longitudinal axis of the heater. The ribbon includes straight segments 26 formed into the helix-like configuration by folded overlapped corner portions 28. A plurality of struts 30 are provided, each being disposed or sandwiched within respective folded corners of the ribbon and are spot welded as denoted by reference 32 to the confronting portions of the ribbon to provide integral struts rigidly affixed to the ribbon in spaced array along the corner portions of the helix-like configuration. The folded corner portions 28 and the interposed struts 30 welded thereto are of lower electrical resistance than that of ribbon 22 and are thus of lower temperature during heater operation. The struts each include two outwardly extending portions 34 and 36 disposed in the planes of the flat confronting surfaces with each outwardly disposed portion being also angularly disposed with respect to an adjacent straight ribbon segment. The outermost ends of the struts are rigidly secured in a refractory base structure 38 with the resistor ribbon being spaced along its active length from the confronting base structure.

A plurality of legs 40 formed with or affixed to the straight segments 26 of the ribbon 22 can also be provided with the outermost ends of these legs being also rigidly secured in the refractory base structure 38. The resistor ribbon 22 is rigidly supported throughout its active length and is spaced from the refractory base such that the base forms no material part of the thermal heater control. The struts 30 and legs 40 are of sufficiently small thermal mass to provide only limited paths for thermal conduction from ribbon 22 to the refractory base 38. During high temperature operation of the heater, relatively little heat is conducted by the struts and legs to the base structure. Thus, the refractory support which is of considerable thermal mass does not detract from overall thermal efficiency as in conventional heater structures.

The refractory base structure 38 can be provided in a single piece or as multiple sections. The base structure is typically formed by casting of a suitable refractory material such as aluminum silicate which is hydraulically set and then fired. The struts 30 and legs 40 are of the same high temperature material as that of ribbon 22.

The heating element 12 is typically formed from a nickel-iron-chromium alloy for heater temperatures of about 1000° C or an iron-chromium-aluminum alloy for heater temperatures of about 1300° C. When used for extremely high temperatures of the order of 1800° C, the heating element is typically formed of molybdenum or tungsten refractory metals. The heating element in typical implementation is formed of a strip of five-eighths × one-eighth inch metal. Struts 30 are typically formed of one-eighth × one-fourth inch strips as are legs 40.

Electrical connection is made to the heater by electrical leads provided at the respective ends of the resistor ribbon. The ends of ribbon 22 terminate in electrical terminals 44 to which an electrical cable from an external electrical power source (not shown) can be connected to energize the heater. An electrically conductive metal strip 46 can be welded to the terminals 44 to reduce the electrical resistance of the terminals and reduce the temperature thereby to provide a more efficient electrical terminal in well known manner. If desired, electrical connection can also be made at points intermediate of the resistor ribbon to provide respective energization of successive sections of the heater as is well known.

The novel heater can be operated near the melting point of the ribbon material as the element is rigidly supported by struts 30, and additionally by legs 40 if desired, affixed to the refractory support. The heater is restrained from bending, sagging, twisting or buckling by the novel rigid supporting arrangement and exhibits a thermal efficiency substantially unaffected by the refractory support structure, as the support structure is not disposed within the heating element itself.

It will be apparent to those skilled in the art that the principles of the invention may be embodied in different configurations to suit particular thermal processing requirements. Accordingly, it is not intended to limit the invention by what has been particularly shown and described except as indicated in the appended claims.

What is claimed is:

1. An electrical resistance heater comprising:

an elongated flat continuous resistor ribbon disposed in a multiple loop helix-like configuration having a plurality of straight segments and a plurality of folded overlapped corner portions, said segments having flat spaced confronting surfaces generally transverse to the longitudinal axis of said helix-like configuration;

a plurality of struts each affixed to said resistor ribbon within a respective corner portion and having first and second end portions each extending outwardly from said ribbon in the planes of said front confronting surfaces with each outwardly disposed end portion being disposed in angular relation with an adjacent straight segment of said ribbon;

a refractory, electrically insulative support in which said struts are secured to maintain said resistor ribbon in spaced relationship to said refractory support; and electrical connecting means for connection of the respective outer ends of said continuous resistor ribbon to an external electrical power source.

2. The electrical resistance heater of claim 1 wherein said continuous resistor ribbon is disposed in a rectangular helical path to provide a plurality of spaced turns defining a helix-like heater structure.

3. The electrical resistance heater of claim 1 wherein said plurality of struts are welded to the confronting corner portions of said ribbon, each strut being spaced along the active length thereof.

4. The electrical resistance heater of claim 1 further including a plurality of legs disposed outwardly from said ribbon in spaced array along said straight segments, the outwardly spaced end portions of said legs being secured in said refractory support to maintain said resistor ribbon in spaced relationship thereto.

5. The electrical resistance heater of claim 1 wherein said refractory support is cast around said struts to secure said ribbon in spaced relationship to the confronting surface of said support.

6. The electrical resistance heater of claim 1 wherein said struts are welded to said resistor ribbon within respective corner portions thereof.

7. The electrical resistance heater of claim 1 wherein said plurality of legs are integrally formed with said resistor ribbon.

* * * * *